US005613343A

United States Patent [19]

Inoue et al.

[11] Patent Number: 5,613,343

[45] Date of Patent: Mar. 25, 1997

[54] MARKING APPARATUS FOR ELECTRONIC COMPONENTS

[75] Inventors: Keiichi Inoue; Hiroyuki Kanitani, both of Kyoto, Japan

[73] Assignee: Murata Manufacturing Co., Ltd., Japan

[21] Appl. No.: 259,549

[22] Filed: Jun. 14, 1994

[30] Foreign Application Priority Data

| | | | |
|---|---|---|---|
| Jun. 16, 1993 | [JP] | Japan | 5-144991 |
| Sep. 2, 1993 | [JP] | Japan | 5-218681 |
| Oct. 7, 1993 | [JP] | Japan | 5-251753 |

[51] Int. Cl.[6] ..... B65B 15/04

[52] U.S. Cl. ..... 53/111 R; 53/54; 53/591; 101/35; 101/37; 101/44

[58] Field of Search ..... 101/43, 44, 35, 101/36, 37; 53/54, 111 R, 131.2, 591

[56] References Cited

U.S. PATENT DOCUMENTS

| | | | |
|---|---|---|---|
| 4,271,757 | 6/1981 | Maxwell et al. | 101/37 |
| 4,398,457 | 8/1983 | Takahashi et al. | 101/44 |
| 4,575,995 | 3/1986 | Tabuchi et al. | 53/591 |
| 4,631,897 | 12/1986 | Slavicek | 53/591 X |
| 4,702,163 | 10/1987 | Araki et al. | 101/35 |
| 4,905,445 | 3/1990 | Saitoh et al. | 53/131.2 X |
| 5,005,338 | 4/1991 | Kemkers et al. | 53/54 X |
| 5,131,206 | 7/1992 | Sillner | 53/54 |
| 5,226,361 | 7/1993 | Grant et al. | 101/35 X |

FOREIGN PATENT DOCUMENTS

| | | |
|---|---|---|
| 0194557 | 9/1986 | European Pat. Off. . |
| 63-150910 | 6/1988 | Japan . |

*Primary Examiner*—Daniel Moon

*Attorney, Agent, or Firm*—Ostrolenk, Faber, Gerb & Soffen, LLP

[57] ABSTRACT

Electronic components are held in first holding portions distributed along a peripheral edge portion of a first rotor, which in turn is intermittently rotated to provide the electronic components with markings. Then, ink providing the markings is cured on a supply track extending from the first rotor toward a second rotor. The electronic components held by the second rotor are successively supplied into cavities of a receiving tape along intermittent rotation of the second rotor. An apparatus for providing the markings comprises a printing plate having printing surfaces, a platen for supporting the electronic components, and a back support, elastically displaceably holding the platen, which can approach to and separate from the printing surfaces.

5 Claims, 8 Drawing Sheets

MARKING APPARATUS FOR ELECTRONIC COMPONENTS

BACKGROUND OF THE INVENTION

1. Field of the Invention

The present invention relates to an apparatus for marking surfaces of electronic components, and more particularly, it relates to a marking apparatus employing a printing method.

2. Description of the Background Art

For example, chip-type electronic components such as multilayer ceramic capacitors or other types of electronic components are provided on surfaces thereof with markings indicating characteristics or the like. One of methods of providing such markings is a printing method employing a printing plate.

Electronic components are marked by such a printing method in the following manner, for example: First, a holder having a plurality of cavities which are arranged in the form of a matrix is so prepared that chip-type electronic components, for example, are charged to be stored one by one in the cavities respectively. On the other hand, a printing plate having printing surfaces which are arranged in positions corresponding to those of the cavities for providing desired markings is prepared. Ink is applied to this printing plate, which in turn is brought into contact with surfaces of the electronic components for providing the same with desired markings.

In the aforementioned printing method for providing markings, the printing pressure of the printing plate which is applied to the electronic components extremely influences defectiveness/non-defectiveness of the markings. However, the tolerance for dimensional dispersion such as dispersion in thickness, for example, of the electronic components often exceeds a proper range of the printing pressure. Therefore, if the electronic components have relatively large thicknesses, for example, the printing surfaces may be crushed or the markings as obtained may be blurred. If the electronic components have relatively small thicknesses, on the other hand, the printing surfaces may be improperly brought into contact with the electronic components, leading to unsatisfactory or incomplete markings.

In the aforementioned printing method for providing markings, further, it is important to align the printing surfaces which are provided on the printing plate with the electronic components, in order to properly mark the electronic components. In particular, higher registration is required as the electronic components are miniaturized.

SUMMARY OF THE INVENTION

Accordingly, an object of the present invention is to provide a marking apparatus for electronic components, which can regularly provide excellent markings regardless of dimensional dispersion of the electronic components.

Another object of the present invention is to provide a printing plate which can align its printing surface with each of electronic components to be marked in high accuracy, and a method of manufacturing the same.

The marking apparatus for electronic components according to the present invention comprises a printing plate having a printing surface for marking electronic components, a platen providing a support surface which is positioned to be opposed to the printing surface for supporting the electronic components to be marked, and a back support, elastically holding the platen in a displaceable manner, which can approach to and separate from the printing surface.

In the marking apparatus according to the present invention, as hereinabove described, the electronic components are supported by the platen which is elastically held by the back support in a displaceable manner. Thus, the platen is displaced with respect to the back support against elasticity for electronic components having dimensions allowing an excessive printing pressure, whereby the printing pressure exerted by the printing plate on the electronic components can be regularly maintained at a proper level. Thus, it is possible to regularly provide the electronic components with excellent markings regardless of dimensional dispersion thereof.

Preferably, the aforementioned marking apparatus further comprises a contact member providing a contact surface which is substantially flush with the printing surface on its periphery, to be in contact with each of the electronic components which is brought into contact with the printing surface. Thus, it is possible to further reliably prevent the printing surface from crushing even if an excessive printing pressure is applied.

Preferably, the marking apparatus according to the present invention further comprises an intermittently rotated discoidal rotor having a plurality of holding portions which are distributed along its peripheral edge portion for holding the electronic components one by one therein respectively. This rotor is aligned with the printing plate and the back support for successively supplying the electronic components between the printing surface and the support surface by its intermittent rotation, and the holding portions render the printing surface and the support surface accessible to the electronic components when the same are positioned at least between the printing surface and the support surface.

Preferably, the printing plate is in the form of a disk having a plurality of printing surfaces which are distributed along its peripheral edge portion, and intermittently rotated in synchronization with the aforementioned rotor. The rotor and the printing plate are so aligned with each other that the plurality of holding portions and the plurality of printing surfaces are successively opposed to each other at a first position on a moving path of the holding portions which is defined by the rotation of the rotor. The marking apparatus preferably further comprises means for successively supplying a plurality of electronic components to the holding portions at a second position followed by the first position on the moving path of the holding portions which is defined by the rotation of the rotor, means for taking out the electronic components from the holding portions at a third position following the first position, and means for applying ink onto the printing surfaces at a fourth position, which is different from the first position, on a moving path of the printing surfaces which is defined by the rotation of the printing plate.

According to the aforementioned preferred mode of the present invention, a step of marking the electronic components is continuously carried out along the intermittent rotation of the rotor, whereby it is possible to efficiently mark a number of electronic components.

According to the present invention, also provided is an apparatus for manufacturing a taped electronic component series, including a marking apparatus of the aforementioned preferred mode. This apparatus for manufacturing a taped electronic component series comprises an intermittently rotated discoidal second rotor having a plurality of second holding portions which are distributed along its peripheral edge portion for holding electronic components one by one therein respectively, in addition to the marking apparatus. The electronic components which are taken out from the first rotor of the marking apparatus are successively supplied to the second holding portions of the second rotor. The plurality of electronic components which are held in the second holding portions of the second rotor are successively supplied to a tape for holding the plurality of electronic components in a state distributed along its longitudinal direction.

According to the aforementioned apparatus for manufacturing a taped electronic component series, therefore, a step of marking the respective electronic components and a step of taping the plurality of electronic components are carried out along the intermittent rotation of the first and second rotors respectively. Thus, it is possible to efficiently manufacture a taped electronic component series.

According to the present invention, further provided is a printing plate which is advantageously applied to the aforementioned marking apparatus for electronic components. This printing plate comprises a base plate of a rigid material having a location hole, and a plate member of cured ultraviolet setting resin which is provided on the base plate for providing a convex printing surface.

According to the aforementioned printing plate, it is possible to position the plate member which is held by the rigid base plate in high accuracy through the location hole provided in the base plate. Therefore, it is possible to align each electronic component to be marked by this printing plate with the printing surface. Further, the base plate can supply the overall printing plate with sufficient rigidity, so that the printing plate is easy to handle.

The aforementioned printing plate can be manufactured as follows: First, the base plate is prepared. This plate is provided with a plurality of projecting alignment pins. On the other hand, an original plate having a plurality of alignment holes for receiving the plurality of alignment pins respectively while providing a negative image corresponding to a desired printing surface is prepared. Then, a resin plate of uncured ultraviolet setting resin is fixed to a surface of the base plate provided with the alignment pins. Then, the original plate is placed on the resin plate and the alignment pins are inserted in the alignment holes, to align the base plate with the original plate. Then, the resin plate is exposed through the original plate, whereby the resin plate is cured in a region corresponding to the negative image. Then, a portion other than the uncured region is removed from the resin plate. Thus, a desired printing plate is obtained.

According to the aforementioned method of manufacturing a printing plate, it is possible to form a plate member on the base plate in alignment with the plurality of alignment pins provided on the base plate in high accuracy. In the printing plate obtained in the aforementioned manner, therefore, it is possible to position the printing surface of the plate member in high accuracy by simply properly positioning the base plate in printing.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
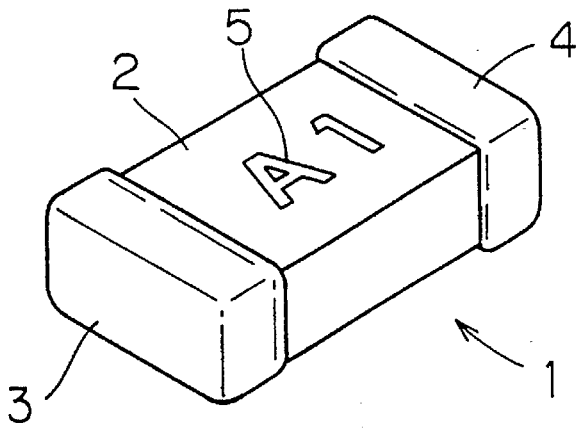
FIG. 1 is a perspective view showing an exemplary electronic component provided with a marking according to the present invention.

FIG. 1 shows a chip-type electronic component 1. For example, a multilayer ceramic capacitor has the appearance shown in FIG. 1. The electronic component 1 comprises a component body 2 of ceramic, for example, and terminal electrodes 3 and 4 which are formed on both end portions of the component body 2. A marking 5 of "A1", for example, is provided on one major surface of the component body 2. The mode of the marking 5, indicating the characteristics of the electronic component 1, for example, is arbitrarily changeable. This marking 5 is provided by printing employing ultraviolet setting ink, for example.

Figure 2:
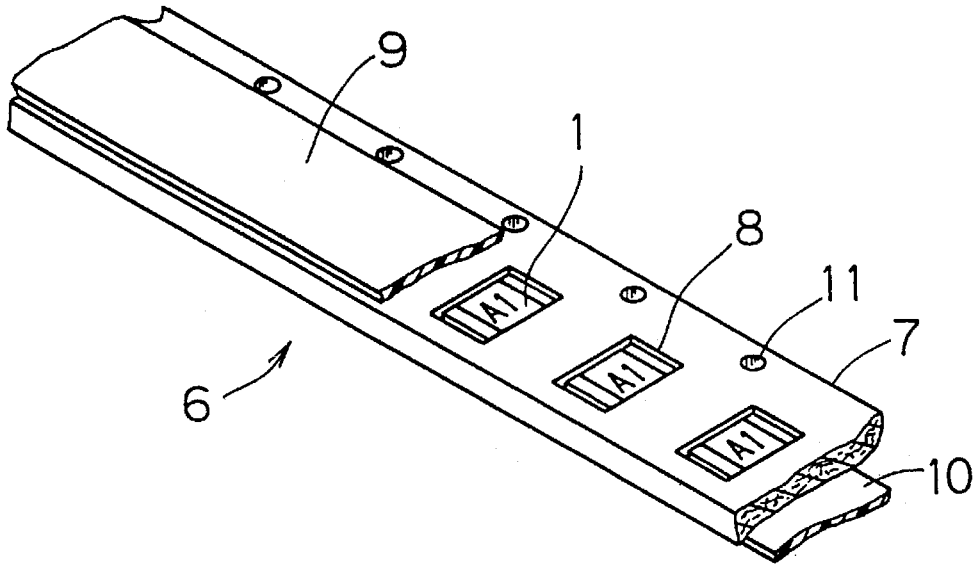
FIG. 2 is a perspective view showing a part of a taped electronic component series which is formed by a plurality of the electronic components shown in FIG. 1.

The electronic component 1 shown in FIG. 1 has small dimensions of 2.0 mm by 1.25 mm by 0.7 mm or 1.6 mm by 0.8 mm by 0.8 mm, for example. While such a miniature electronic component 1 is mounted on a proper circuit board, a plurality of electronic components 1 are often brought into the form of a taped electronic component series 6 as shown in FIG. 2, so that each electronic component 1 is improved in handleability in such a mounting step or the like. In the taped electronic component series 6, the plurality of electronic components 1 are held by a tape to be distributed along its longitudinal direction. In more concrete terms, the taped electronic component series 6 comprises a receiving tape 7 of cardboard, for example. The receiving tape 7 is provided with cavities 8 which are distributed along its longitudinal direction for receiving the electronic components 1 one by one therein respectively. Upper and lower openings of the cavities 8 are closed by a top sheet 9 and a bottom sheet 10 which are applied onto the receiving tape 7 respectively. The receiving tape 7 is further provided with a plurality of sprocket holes 11 which are distributed along its longitudinal direction.

In order to tape the plurality of electronic components 1, the receiving tape 7 provided with only the bottom sheet 10 is first prepared. Then, the electronic components 1 are inserted in the respective cavities 8, and the top sheet 9 is applied onto the receiving tape 7 to close the upper openings of the cavities 8.

Figure 3:
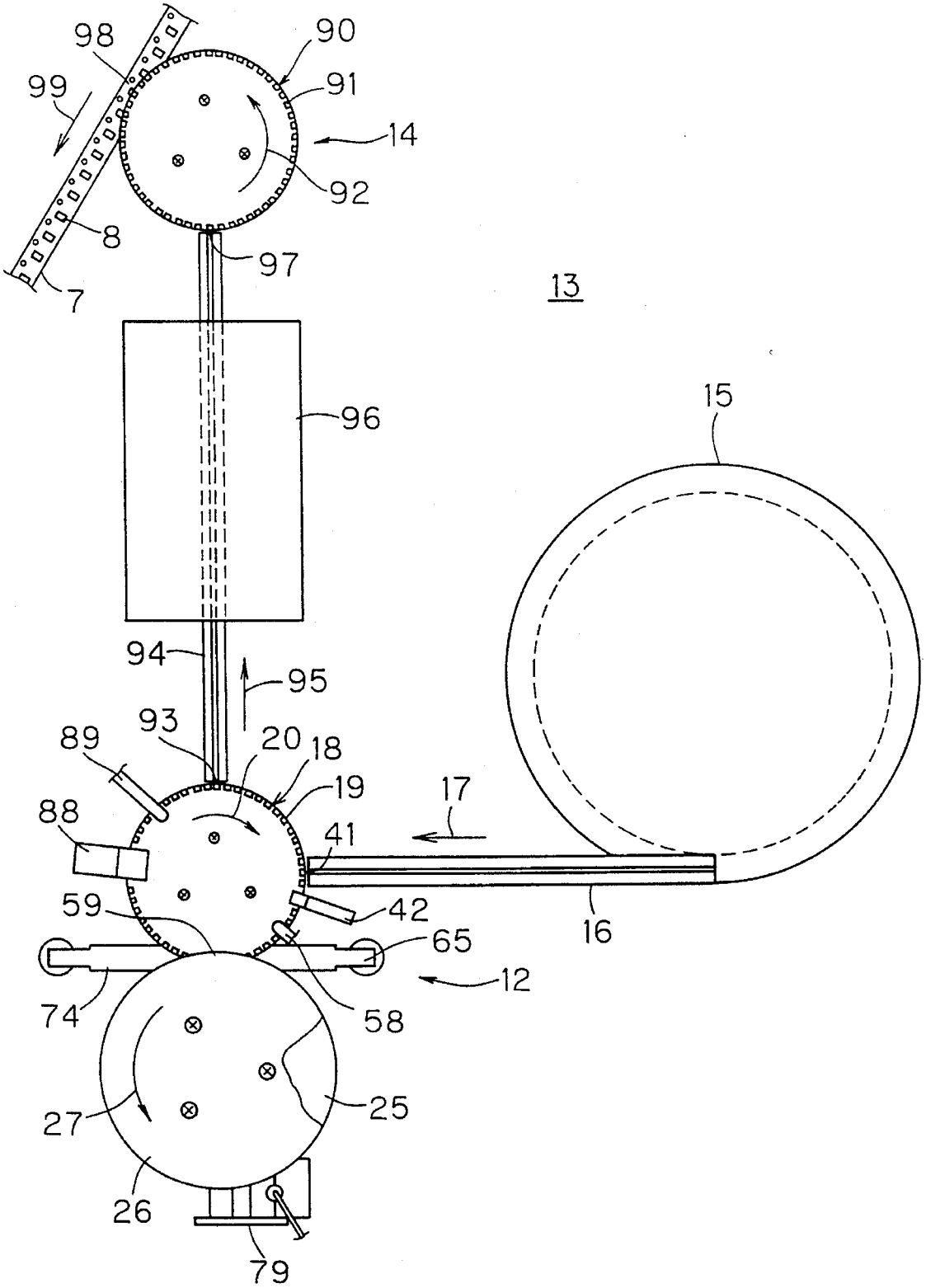
FIG. 3 is a plan view schematically showing an apparatus for manufacturing a taped electronic component series according to an embodiment of the present invention.

FIG. 3 shows an apparatus 13 for manufacturing a taped electronic component series, including a marking apparatus 12 according to an embodiment of the present invention. This apparatus 13 is adapted to provide each electronic component 1 with the marking 5 as shown in FIG. 1, and then to tape a plurality of electronic components 1 as shown in FIG. 2. The electronic components 1 are provided with the markings 5 by the marking apparatus 12, and taped by a taping device 14.

The apparatus 13 comprises a part feeder 15, which receives a plurality of electronic components 1 (not shown in FIG. 3). The plurality of electronic components 1 which are delivered from the part feeder 15 are directed to a prescribed direction and supplied toward a first rotor 18 along a supply track 16 in a tandem state, as shown by arrow 17. The first rotor 18 is in the form of a disk having a plurality of, e.g., 50 concave first holding portions 19 which are distributed along its peripheral edge portion. The rotor 18 is intermittently rotated along arrow 20. Due to such intermittent rotation, the plurality of holding portions 19 are successively brought into a prescribed position upon stoppage of the rotor 18.

Figure 4:
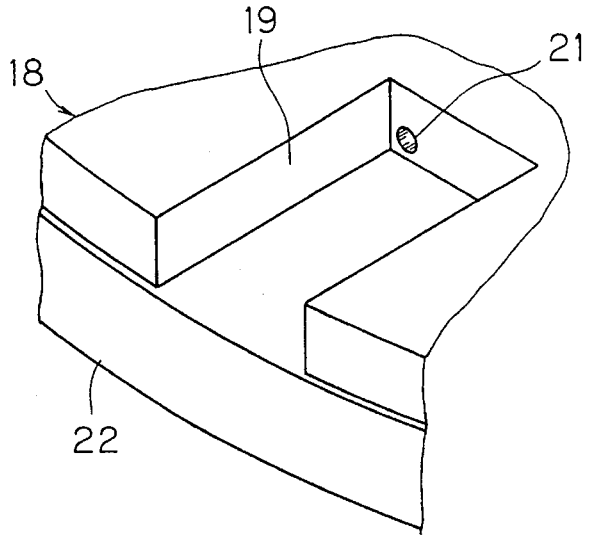
FIG. 4 is a perspective view showing a part of a first rotor shown in FIG. 3 in an enlarged manner.
Figure 5:
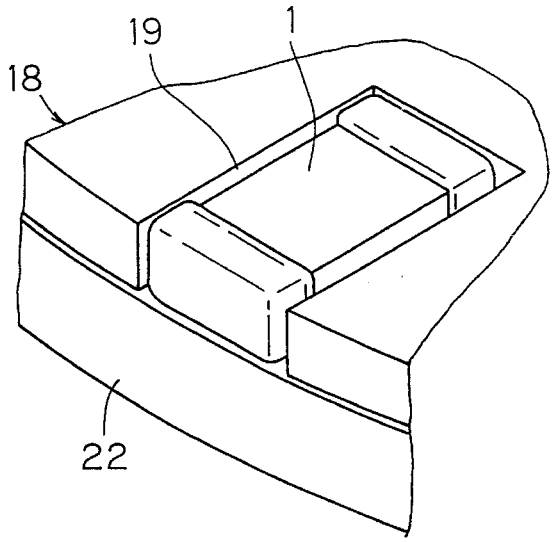
FIG. 5 is a perspective view showing an electronic component which is held in a holding portion provided in the first rotor shown in FIG. 4.

FIG. 4 shows one of the holding portions 19 in an enlarged manner. Each holding portion 19 holds a single electronic component 1, as shown in FIG. 5. A negative pressure is applied to each holding portion 19 through a suction passage 21, to position the electronic component 1 in the holding portion 19. In order to improve positioning accuracy for the electronic component 1 in the holding portion 19, the suction passage 21 is preferably provided in a position close to one side of the holding portion 19, as shown in FIG. 4.

As shown in FIGS. 4 and 5, a bottom plate 22 is arranged under the rotor 18 to define a bottom surface of each holding portion 19. This bottom plate 22 is fixed to support the electronic component 1 which is positioned in each holding portion 19 from below, thereby reliably preventing dropping of the electronic component 1 from the holding portion 19.

Figure 6:
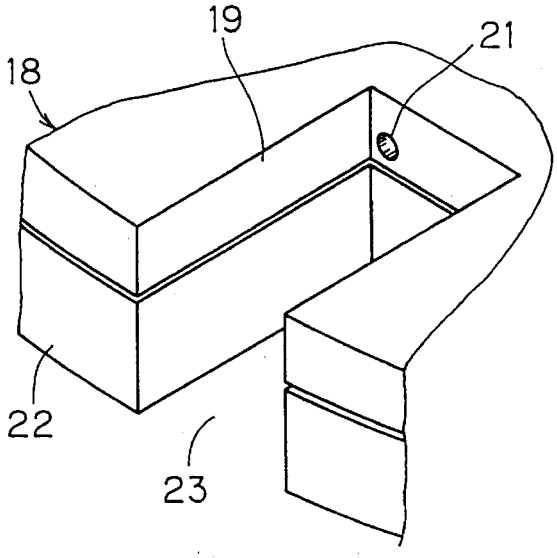
FIG. 6 is a perspective view showing another part of the first rotor shown in FIG. 3.
Figure 7:
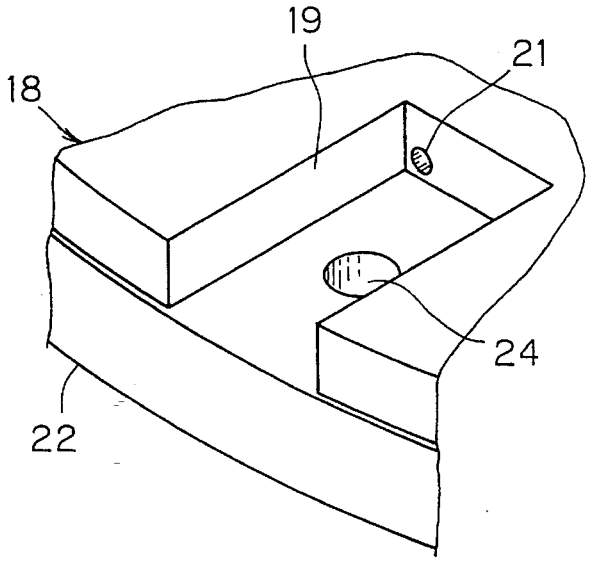
FIG. 7 is a perspective view showing still another part of the first rotor shown in FIG. 3.

As shown in FIG. 6, a notch 23 is provided in a specific portion of the bottom plate 22. Further, an air blow passage 24 is provided in another portion of the bottom plate 22, as shown in FIG. 7. Positions and functions of the notch 23 and the air blow passage 24 are described later.

Referring again to FIG. 3, a discoidal printing plate 25 is arranged to partially overlap with the first rotor 18. This printing plate 25 is mounted on a lower surface of a discoidal holding plate 26. The printing plate 25 and the holding plate 26 are intermittently rotated along arrow 27. The printing plate 25 is manufactured through steps shown in FIGS. 8 to 14.

Figure 8:
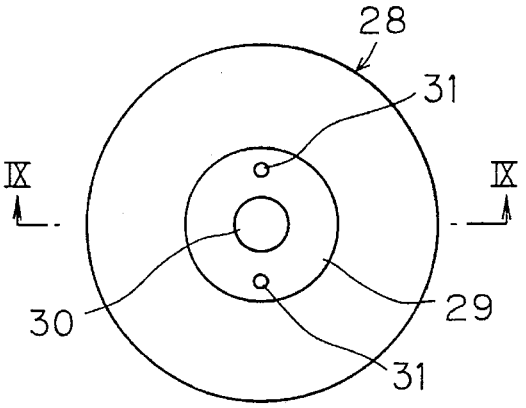
FIG. 8 is a bottom plan view of a base plate which is included in a printing plate shown in FIG. 3.
Figure 9:
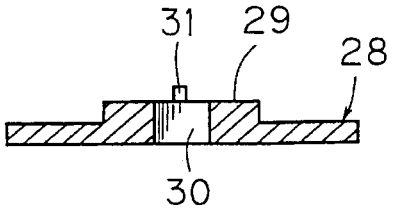
FIG. 9 is a sectional view taken along the line IX—IX in FIG. 8.

A circular base plate 28 is prepared as shown in FIGS. 8 and 9. This base plate 28 is made of a rigid material such as aluminum, for example. A relatively thick boss 29 is formed on a central portion of the base plate 28, and a location hole 30 is provided in a central portion of the boss 29, to pass through the base plate 28. A plurality of, e.g., two alignment pins 31 are provided to project from the boss 23, in prescribed positional relations with respect to the location hole 30.

Figure 10:
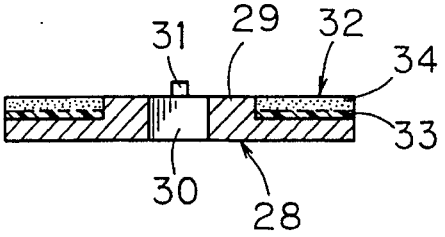
FIG. 10 is a sectional view corresponding to FIG. 9, showing a resin plate which is fixed onto the base plate.

Then, a resin plate 32 of uncured ultraviolet setting resin is fixed to the base plate 28 on a side provided with the alignment pins 31, as shown in FIG. 10. This fixation is attained by applying the resin plate 32 onto the base plate 28 by an adhesive double coated sheet, for example. The resin plate 32 is positioned around the boss 29, so that its upper surface is preferably flush with that of the boss 29. The resin plate 32 which is fixed to the base plate 28 in the aforementioned manner is preferably already cured in a part along its thickness on a side facing the base plate 28. Referring to FIG. 10, numeral 33 denotes a cured portion, and numeral 34 denotes an uncured portion. Such presence of the cured portion 33 facilitates handling of the resin plate 32, so that the same can be reliably fixed to the base plate 28. When the base plate 28 is made of a light-transmittant material such as glass, it is possible to form the cured portion 33 by irradiating the resin plate 32 with ultraviolet light through the base plate 28 after the resin plate 32 is applied to the base plate 28.

Figure 11:
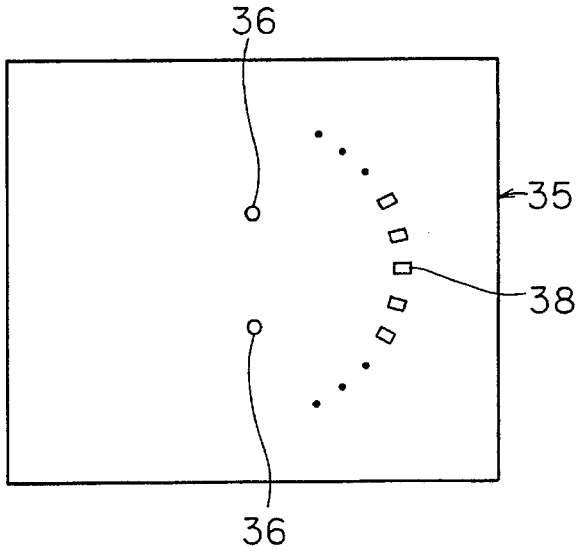
FIG. 11 is a plan view showing an original plate which is prepared for manufacturing the printing plate shown in FIG. 3.
Figure 13:
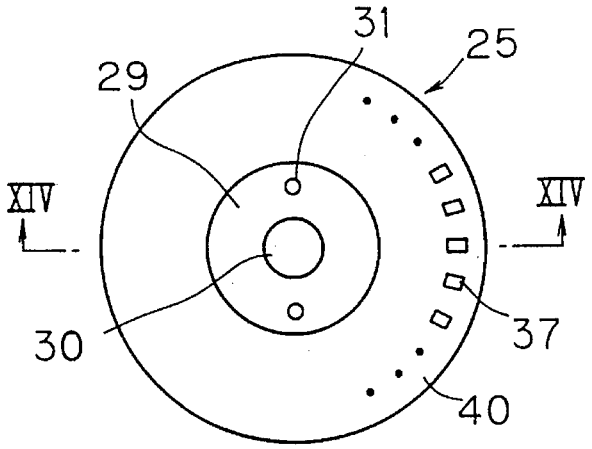
FIG. 13 is a bottom plan view corresponding to FIG. 8, illustrating the printing plate shown in FIG. 3.

On the other hand, an original plate 35 is prepared as shown in FIG. 11. The original plate 35, which is made of polyethylene terephthalate, for example, is in the form of a film having a rectangular shape as a whole. This original plate 35 is provided with two alignment holes 36, for example, in correspondence to the positions of the aforementioned alignment pins 31. The original plate 35 is further provided with negative images 38, corresponding to desired convex printing surfaces 37 (see FIGS. 13 and 14) to be formed in the printing plate 25 to be obtained, in prescribed positional relations with respect to the alignment holes 36. The negative images 38 shown in Fig. 11 and the printing surfaces 37 shown in FIG. 13 are simply illustrated as mere rectangles. In order to provide the marking 5 of "A1" as shown in FIG. 1, each printing surface 37 has a mirror image of "A1", and each negative image 38 has a shape corresponding to the printing surface 37. The negative images 38 are arranged along the circumference of the original plate 35.

Figure 12:
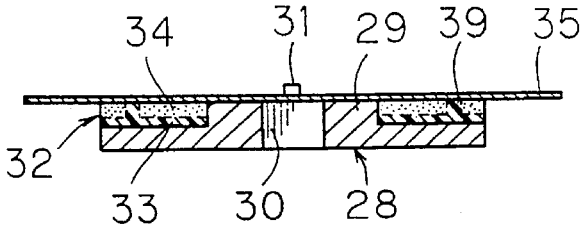
FIG. 12 is a sectional view corresponding to FIG. 9, showing the original plate which is aligned with the base plate.

Then, the original plate 35 is placed on the resin plate 32, as shown in FIG. 12. At this time, the alignment pins 31 of the base plate 28 are inserted in the alignment holes 36 of the original plate 35, thereby aligning the base plate 28 and the original plate 35 with each other.

In the aforementioned state shown in FIG. 12, the original plate 35 is irradiated with ultraviolet light, so that the resin plate 32 is exposed through the original plate 35. Thus, the uncured portion 34 of the resin plate 32 is cured in regions corresponding to the negative images 38 (FIG. 11). Referring to FIG. 12, numeral 39 denotes a portion which is cured in a region corresponding to each negative image 38. Thus, the resin plate 32 has the cured portions 33 and 39 and the uncured portion 34.

Figure 14:
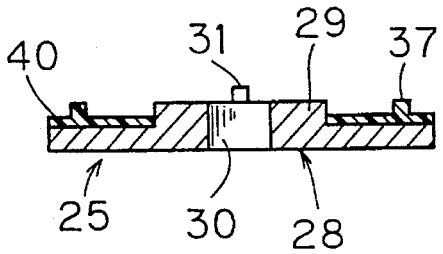
FIG. 14 is a sectional view taken along the line XIV—XIV in FIG. 13.

Then, the original plate 35 is removed and the uncured portion 34 is washed out with a liquid such as water or alcohol in this state. Referring to FIGS. 13 and 14, the uncured portion 34 is completely removed.

FIGS. 13 and 14 show the printing plate 25 as completed, having a plate member 40 which is formed on the base plate 28 for providing the convex printing surfaces 37 of cured ultraviolet setting resin. In this printing plate 25, the plurality of printing surfaces 37 are arranged along its circumference.

The printing plate 25 obtained in the aforementioned manner is mounted on the lower surface of the holding plate 26 as shown in FIG. 3, to downwardly direct the printing surfaces 37. The holding plate 26 is provided with a locating projection (not shown) for engaging with the location hole 30, so that the printing plate 25 is properly positioned on the holding plate 26 by the location hole 30 and the locating projection.

As shown in FIG. 3, the plurality of electronic components 1 which are fed along the aforementioned supply track 16 are successively supplied into the first holding portions 19 at a first position 41 on a moving path of the holding portions 19 which is defined by the rotation of the first rotor 18. Thus, each electronic component 1 is received in each holding portion 19, as shown in FIG. 5.

Figure 15:
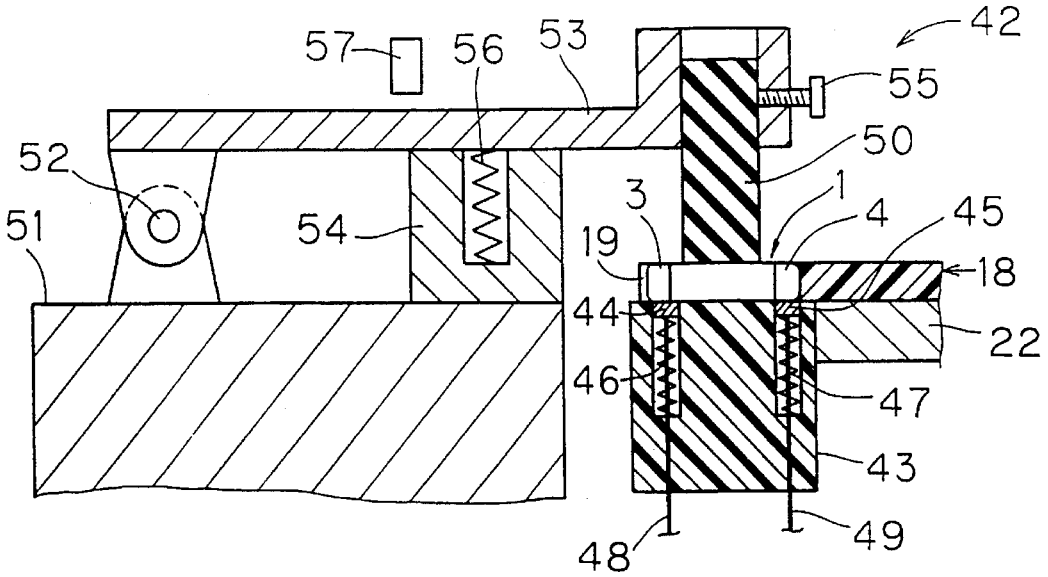
FIG. 15 is a sectional view showing a principal part of a characteristic measuring device which is provided in relation to the first rotor shown in FIG. 3.

The electronic components 1 pass through a position provided with a characteristic measuring device 42 along the intermittent rotation of the rotor 18. When the electronic components 1 are multilayer ceramic capacitors, for example, the characteristic measuring device 42 is adapted to measure electrostatic capacitances thereof. FIG. 15 shows this characteristic measuring device 42 in detail.

Referring to FIG. 15, a terminal block 43 is mounted on the bottom plate 22. This terminal block 43 is provided with measuring terminals 44 and 45, which are brought into contact with terminal electrodes 3 and 4 of each electronic component 1. The measuring terminals 44 and 45 are urged by springs 46 and 47 respectively to slightly project into each holding portion 19, so that the same are further reliably brought into contact with the terminal electrodes 3 and 4. These measuring terminals 44 and 45 are respectively connected with electric wires 48 and 49, which are connected to an electrostatic capacitance measuring device (not shown).

Each electronic component 1 is downwardly pushed by a pusher 50, so that the measuring terminals 44 and 45 are further reliably brought into contact with the terminal electrodes 3 and 4. The pusher 50 is preferably made of an electrical insulating material, more preferably of an elastic material. This pusher 50 is mounted on an end of a lever 53 which is provided to be rotatable with respect to a fixed surface 51 through a pivot shaft 52. An electromagnet 54 is mounted on the fixed surface 51, so that the lever 53 is attracted by the electromagnet 54 when the same is on, as shown in FIG. 15. Thus, the pusher 50 presses each electronic component 1 preferably at an adjustable degree of pressing. Thus, the positional relation between the pusher 50 and the lever 53 is rendered adjustable, so that the adjusted position of the pusher 50 is fixed by a set screw 55. When the electromagnet 54 is off, on the other hand, the lever 53 is anticlockwisely rotated about the pivot shaft 52 by an action of the spring 56, so that the pusher 50 separates from the electronic component 1. A stop 57 which can be brought into contact with the lever 53 is provided for defining a terminating end of such anticlockwise rotation of the lever 53.

Along the intermittent rotation of the rotor 18, the pusher 50 presses every electronic component 1 which is positioned on the terminal block 43, whereby the measuring terminals 44 and 45 are reliably brought into contact with the terminal electrodes 3 and 4 for measuring characteristics of the electronic component 1. At least the surface of the rotor 18 is preferably made of an electrical insulating material, to cause no undesired electric short during such characteristic measurement.

Any electronic component 1 which is decided as having improper characteristics in the aforementioned characteristic measurement is then discharged from the corresponding holding portion 19. FIG. 3 shows a discharge tube 58 for discharging such a defective electronic component 1. This discharge tube 58 removes the defective electronic component 1 from the holding portion 19 on the basis of vacuum suction. In order to further reliably remove the defective electronic component 1 by the discharge tube 58, the air blow passage 24 is provided in the bottom plate 22 as shown in FIG. 7, in correspondence to the position provided with the discharge tube 58. This air blow passage 24 blows compressed air toward the holding portion 19, thereby forcing the defective electronic component 1 into the discharge tube 58. Such an air blow passage 24 may not be provided in particular, but the suction passage 21 can also be employed for blowing compressed air therethrough.

The marking 5 shown in FIG. 1 is provided in a second position 59 following the first position 41 on the moving path of the holding portions 19 which is defined by the rotation of the rotor 18, i.e., a position following that provided with the discharge tube 58 in this embodiment. The first rotor 18 and the printing plate 25 overlap with each other at this second position 59. FIGS. 19 to 22 show the structure of a portion around the second position 59 in detail.

Figure 20:
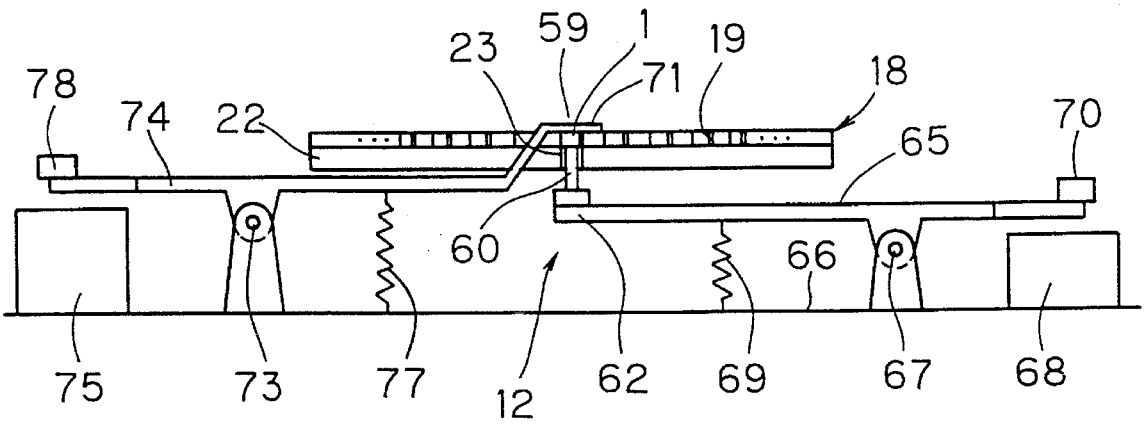
FIG. 20 is a front elevational view showing the elements appearing in FIG. 19.
Figure 21:
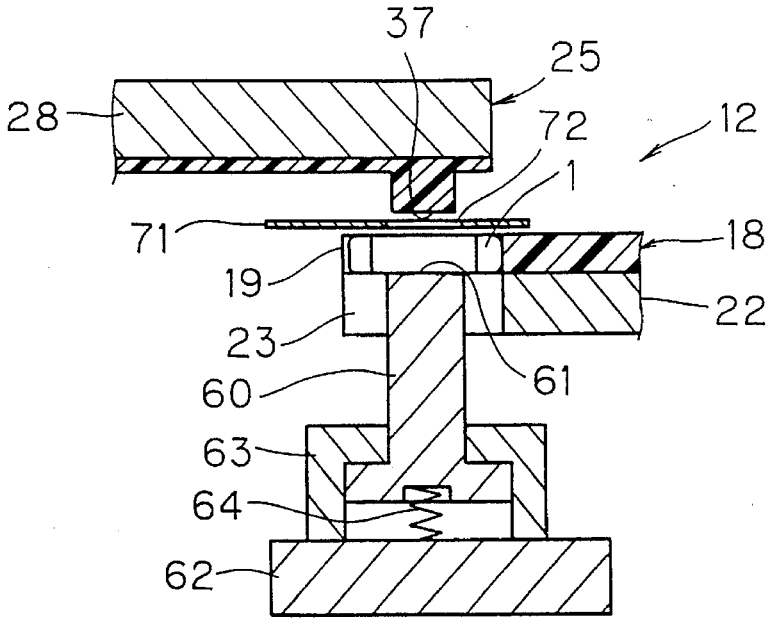
FIGS. 21 and 22 are sectional views showing a principal part of the marking apparatus, for illustrating fan operation achieved in the marking apparatus.
Figure 22:
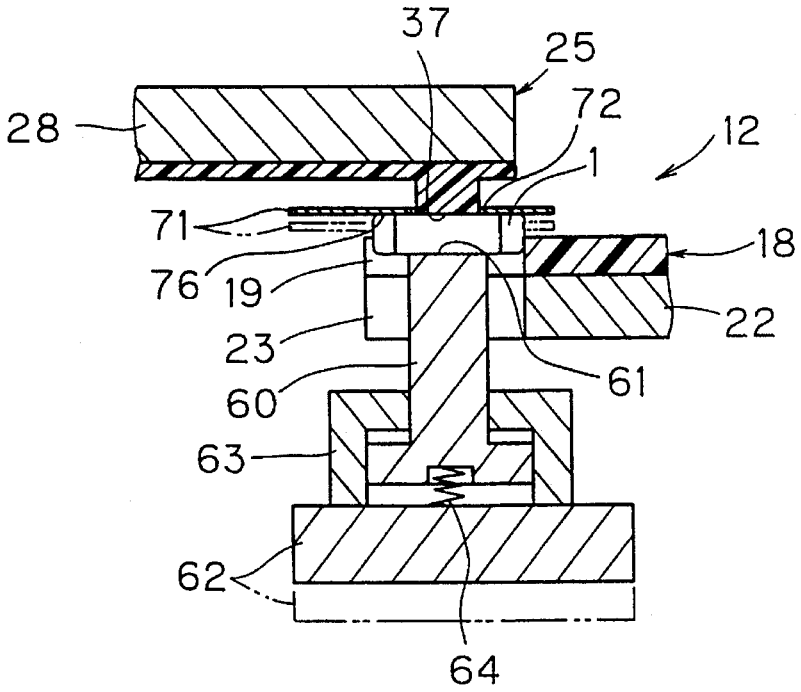

In the second position 59, the bottom plate 22 is provided with the notch 23 as shown in FIG. 6. As shown in FIGS. 20 to 22, a platen 60 is positioned in this notch 23. This platen 60 provides a support surface 61 for supporting each electronic component 1. This support surface 61 is opposed to each printing surface 37. The platen 60 is elastically displaceably held by a back support 62. More specifically, a guide 63 is mounted on the back support 62, thereby holding the platen 60 to be vertically displaceable with respect to the back support 62 within a prescribed range. A spring 64 is arranged between the platen 60 and the back support 62 for urging the platen 60, so that its support surface 61 approaches to each printing surface 37.

According to this embodiment, the back support 62 is provided by an end of a lever 65. As shown in FIG. 20, the lever 65 is mounted to be rotatable with respect to a fixed surface 66 through a pivot shaft 67. Due to rotation of the lever 65, therefore, the back support 62 can approach to and separate from each printing surface 37. An electromagnet 68 is provided on the fixed surface 66, so that the lever 65 is clockwisely rotated in FIG. 20 about the pivot shaft 67 and the back support 62 approaches to each printing surface 37 when the electromagnet 68 is on. When the electromagnet 68 is off, on the other hand, the lever 65 is anticlockwisely rotated by an action of the spring 69 and the back support 62 separates from each printing surface 37. A stop 70 defines a terminating end of the anticlockwise rotation of the lever 65.

In the second position 59, a contact member 71 is positioned above the rotor 18. This contact member 71 has a through hole 72 for receiving each printing surface 37. The contact member 71 is provided on an end of a lever 74 which is mounted to be rotatable with respect to the fixed surface 66 through a pivot shaft 73.

An electromagnet 75 is mounted on the fixed surface 66, so that the lever 74 is anticlockwisely rotated in FIG. 20 about the pivot shaft 73 when the electromagnet 75 is on. Thus, the contact member 71 provides a contact surface 76 which comes into contact with each printing surface 37, as shown by solid lines in FIG. 22. This contact surface 76 is substantially flush with each printing surface 37 on its periphery. In the state shown in FIG. 22, the contact surface 76 may be exactly flush with the printing surface 37, or may slightly upwardly separate from the printing surface 37 by 0.1 mm, for example.

When the electromagnet 75 is off, on the other hand, the lever 74 is clockwisely rotated in FIG. 20 by an action of a spring 77. A stop 78 defines a terminating end of this rotation. Due to such clockwise rotation, the contact member 71 is downwardly displaced as shown in Fig. 21, so that the printing surface 37 is positioned above the through hole 72.

The rotor 18 and the printing plate 25 are intermittently rotated in synchronization with each other, so that the state shown in FIG. 21 is attained every stoppage of the rotation. In this state, the electromagnet 68 is turned on to upwardly displace the back support 62 as shown in FIG. 22. Referring to FIG. 22, the position of the back support 62 in the state shown in FIG. 21 is illustrated by phantom lines. In response to the aforementioned upward displacement of the back support 62, the platen 60 pushes up the electronic component 1, to bring the same into contact with the printing surface 37. The spring 64 enables the electronic component 1 to come into contact with the printing surface 37 substantially at a constant pressure.

The electromagnet 75 is turned on simultaneously with or slightly in advance of the aforementioned upward displacement of the back support 62, whereby the contact member 71 is also upwardly displaced as shown in FIG. 22. Referring to FIG. 22, the position of the contact member 71 in the state shown in FIG. 21 is illustrated by phantom lines. The contact member 71 provides the contact surface 76 which is substantially flush with the printing surface 37 on its periphery, and the electronic component 1 is brought into contact with the contact surface 76 so that the electronic component 1 and the printing surface 37 are prevented from application of an excessive printing pressure.

Thus, the electronic component 1 is marked by the printing surface 37. Thereafter the back support 62 is downwardly displaced as shown in FIG. 21, thereby downwardly displacing the platen 60 as well as the contact member 71. Due to the downward displacement of the contact member 71, the electronic component 1 is forced to separate from the printing surface 37. Then the electronic component 1 is returned to the prescribed position of the holding portion 19 again.

Figure 16:
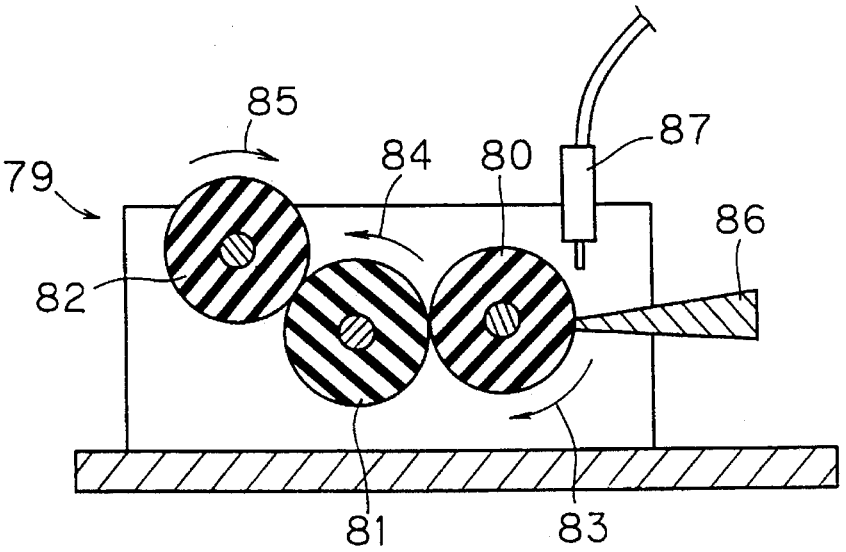
FIG. 16 is a sectional view showing an ink applicator which is provided in relation to the printing plate shown in FIG. 3.

Along the aforementioned intermittent rotation of the printing plate 25, the printing surfaces 37 are coated with ultraviolet setting ink, for example. FIG. 3 shows an ink applicator 79, which is illustrated in FIG. 16 in detail.

The ink applicator 79 comprises an ink fountain roller 80, an ink distributing roller 81 and an ink form roller 82, being successively in contact with each other, which are rotated along arrows 83, 84 and 85 respectively. These rollers 80 to 82 are made of rubber respectively. A blade 86 is arranged with a prescribed clearance between the same and the ink fountain roller 80. A dispenser 87 is arranged above the clearance between the blade 86 and the ink fountain roller 80, for dripping ink. The ink dripped from the dispenser 87 is guided onto a surface of the ink fountain roller 80 through the clearance between the blade 86 and the ink fountain roller 80, and its flowability is maintained by an action of the ink distributing roller 81, for forming an ink film having a uniform thickness on the ink form roller 82. The ink distributing roller 81 may also be swung along its axis, in addition to the rotation along arrow 84.

Figure 17:
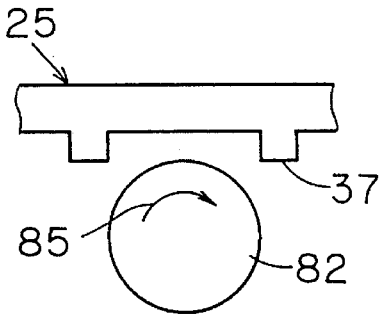
FIGS. 17 and 18 are adapted to illustrate operations of the printing plate and an ink form roller for applying ink from the ink form roller shown in FIG. 16 to printing surfaces of the printing plate.
Figure 18:
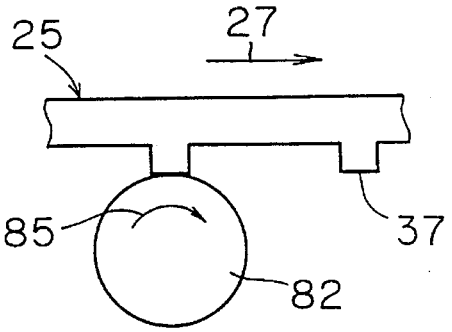
Figure 19:
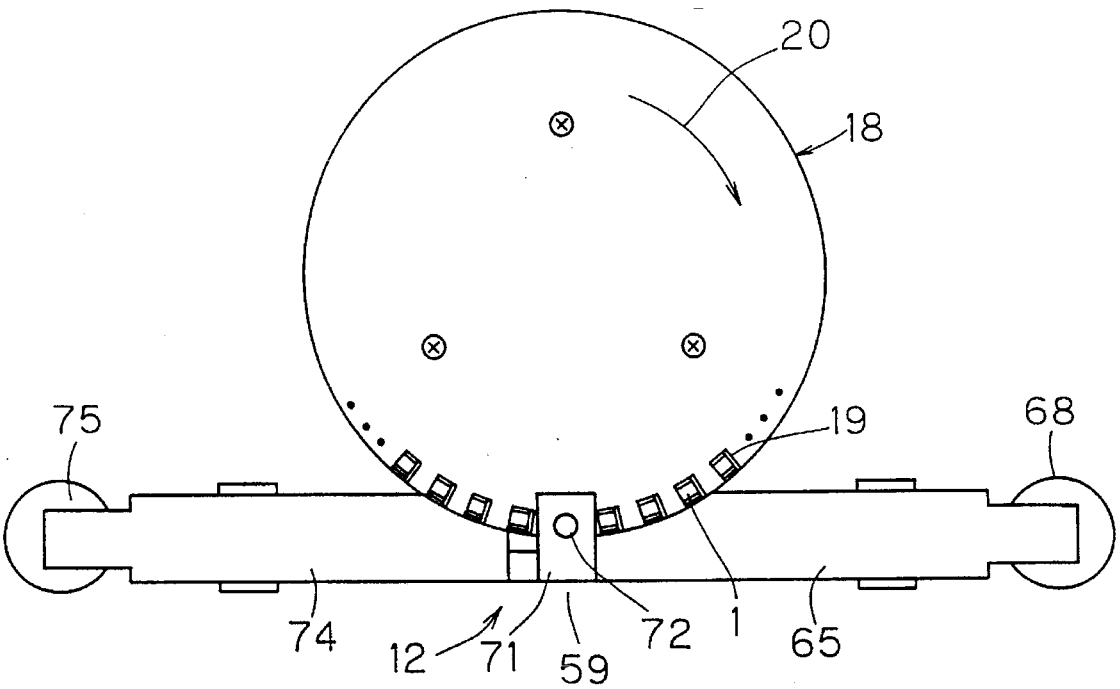
FIG. 19 is a plan view showing a part of a marking apparatus which is provided in relation to the first rotor shown in FIG. 3.

As shown in FIGS. 17 and 18, the ink provided on the ink form roller 82 is applied onto the printing surfaces 37. The ink form roller 82 is continuously rotated along arrow 85, as shown in FIGS. 17 and 18. Referring to Fig. 17, the printing plate 25 is stopped after the intermittent rotation. Then the printing plate 25 is rotated along arrow 27, so that one of the printing surfaces 37 comes into contact with a peripheral surface of the ink form roller 82 as shown in FIG. 18, to be coated with the ink. The peripheral speed of the ink form roller 82 is preferably substantially matched with the moving speed of each printing surface 37 following the rotation of the printing plate 25.

The aforementioned ink applicator 79 is preferably easily exchangeable with another ink applicator as a unit. Thus, it is possible to quickly cope with change of the type of the ink to be employed.

Referring again to FIG. 3, each electronic component 1 passing through the second position 59 for marking is brought into a position under an image sensor 88 by the intermittent rotation of the first rotor 18. The image sensor 88 is turned on in synchronization with the stop timing of the rotor 18, to decide defectiveness/non-defectiveness of the marking 5 (FIG. 1) provided on each electronic component 1.

A discharge tube 89 is arranged following the image sensor 88. This discharge tube 89 is adapted to take out any electronic component 1 which is decided as having a defective marking 5 by the image sensor 88, on the basis of vacuum suction. Also in the position provided with the discharge tube 89, the bottom plate 22 may have the air blow passage 24 as shown in FIG. 7, so that the air blow passage 24 blows compressed air for reliably forcing the defective electronic component 1 to be discharged into the discharge tube 89.

A second rotor 90 is arranged on a position different from that of the first rotor 18. The second rotor 90 is in the form of a disk, which is provided with a plurality of, e.g., 50 second holding portions 91 distributed along its peripheral edge portion for receiving the electronic components 1 one by one therein respectively. The second rotor 90 is intermittently rotated along arrow 92. The second rotor 90 is substantially similar in structure to the first rotor 18, and a bottom plate (not shown) corresponding to the bottom plate 22 is also arranged in relation to the second rotor 90.

A supply track 94 is provided to extend from a third position 93 following the second position 59 on the moving path of the first holding portions 19 which is defined by the rotation of the first rotor 18, i.e., a position following that of the discharge tube 89 in this embodiment, toward the position provided with the second rotor 90. The electronic components 1 are fed to the supply track 94 from the holding portions 19 which are located in the third position 93. Thus, all electronic components 1 provided on the supply track 94 have been decided as proper in both of the characteristics and the markings 5. Along this supply track 94, the plurality of electronic components 1 are carried along arrow 95 in a tandem state. A sensor (not shown) is preferably provided for detecting any electronic component 1 which fails to be fed onto the supply track 94 at the third position 93 and still remains in the corresponding first holding portion 19, to remove the remaining electronic component 1 on the basis of a result of detection.

On the supply track 94, the electronic components 1 upwardly direct the surfaces provided with the markings 5 (FIG. 1). The supply track 94 passes through an ultraviolet curing oven 96. During movement on the supply track 94, therefore, the ultraviolet setting ink employed for marking the electronic components 1 is cured. The length of the supply track 94 is so selected that the ink is irradiated with ultraviolet light for a time required for such curing.

The electronic components 1 fed along the supply track 94 are successively supplied into the second holding portions 91 at a fourth position 97 on a moving path of the second holding portions 91 which is defined by rotation of the second rotor 90.

These electronic components 1 are brought into a fifth position 98 following the fourth position 97, along the rotation of the second rotor 90. At the fifth position 98, the receiving tape 7 provided with the bottom sheet 10 as shown in FIG. 2 in detail is intermittently fed along arrow 99. Thus, the electronic components 1 which are held in the second holding portions 91 are successively supplied into the cavities 8 of the receiving tape 7 every time the second rotor 90 and the receiving tape 7 are stopped. A pusher or a suction chuck (not shown), for example, is employed for supplying the electronic components 1 into the cavities 8. After the electronic components 1 are inserted in the respective cavities 8, the top sheet 9 is applied onto the receiving tape 7, thereby obtaining the desired taped electronic component series 6 as shown in FIG. 2.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for manufacturing a taped electronic component series, comprising:

an intermittently rotated discoidal first rotor having a plurality of first holding portions being distributed along its peripheral edge portion for holding electronic components one by one therein respectively;

supply means for successively supplying a plurality of said electronic components into said first holding portions respectively at a position on a moving path of said first holding portions being defined by rotation of said first rotor;

marking means for marking respective said electronic components at a marking position on said moving path of said first holding portions, said marking means comprising a discoidal printing plate having a plurality of printing surfaces being distributed along its peripheral edge portion for marking said electronic components respectively, said printing plate being intermittently rotated in synchronization with said first rotor thereby successively locating said plurality of printing surfaces at said marking position, said marking means further comprising displacing means for displacing said electronic components toward said printing surfaces in said marking position;

an intermittently rotated discoidal second rotor, being arranged on a position different from that of said first rotor, having a plurality of second holding portions being distributed along its peripheral edge portion for holding said electronic components one by one therein respectively;

carriage/supply means for carrying said electronic components from said first holding portions and successively supplying said plurality of electronic components into said second holding portions respectively; and means for successively supplying said plurality of electronic components from said second holding portions toward a tape for holding said plurality of electronic components while distributing the same along its longitudinal direction.

2. An apparatus for manufacturing a taped electronic component series in accordance with claim 1, further comprising means for measuring characteristics of said electronic components being held in said first holding portions, and means for discharging those of said electronic components having improper characteristics from corresponding said first holding portions, said characteristic measuring means and said discharge means being arranged on said moving path of said first holding portions.

3. An apparatus for manufacturing a taped electronic component series in accordance with claim 1, further comprising means for deciding defectiveness/non-defectiveness of markings provided on said electronic components being held in said first holding portions, and means for discharging those of said electronic components having defective markings from corresponding said first holding portions, said decision means and said discharge means being arranged on said moving path of said first holding portions.

4. An apparatus for manufacturing a taped electronic component series in accordance with claim 1, wherein ultraviolet setting ink is applied onto said printing surfaces for marking said electronic components, said carriage/supply means including an ultraviolet curing oven for curing said ink.

5. An apparatus for manufacturing a taped electronic component series in accordance with claim 1, wherein said displacing means comprises a platen providing a support surface being positioned to be opposed to said printing surfaces for supporting said electronic components, and a back support, elastically displaceably holding said platen, being capable of approaching to and separating from said printing surfaces.

* * * * *